US008151804B2

(12) United States Patent
Williams

(10) Patent No.: US 8,151,804 B2
(45) Date of Patent: Apr. 10, 2012

(54) TOBACCO CURING METHOD

(76) Inventor: Jonnie R. Williams, Manakin-Sabot, VA (US)

( * ) Notice: Subject to any disclaimer, the term of this patent is extended or adjusted under 35 U.S.C. 154(b) by 441 days.

(21) Appl. No.: 12/342,192

(22) Filed: Dec. 23, 2008

(65) Prior Publication Data

US 2010/0154810 A1 Jun. 24, 2010

(51) Int. Cl.
*A24B 15/22* (2006.01)

(52) U.S. Cl. ..... 131/299; 131/352; 131/292; 131/303; 131/290; 131/297

(58) Field of Classification Search ..... None
See application file for complete search history.

(56) References Cited

U.S. PATENT DOCUMENTS

| | | | |
|---|---|---|---|
| 240,252 | A | 4/1881 | Huck |
| 514,370 | A | 2/1894 | Knott |
| 1,017,713 | A | 2/1912 | Vaughan |
| 1,194,351 | A | 8/1916 | Benjamin |
| 1,339,373 | A | 5/1920 | Buensod |
| 1,543,245 | A | 6/1925 | Buensod |
| 1,545,811 | A | 6/1925 | Buensod |
| 1,568,316 | A | 1/1926 | Buensod |
| 2,082,289 | A | 6/1937 | Hodgin |
| 2,124,012 | A | 7/1938 | Smith, Jr. |
| 2,134,843 | A | 11/1938 | Rouse |
| 2,343,345 | A | 3/1944 | Touton |
| 2,475,568 | A | 7/1949 | Moore, Jr. |
| 2,534,618 | A | 12/1950 | Moore, Jr. |
| 2,758,603 | A | 8/1956 | Heljo |
| 2,989,057 | A | 6/1961 | Touton |
| 3,024,792 | A | 3/1962 | Touton |
| 3,039,475 | A | 6/1962 | Neukomm et al. |
| 3,105,713 | A | 10/1963 | Hassler |
| 3,109,637 | A | 11/1963 | Taylor |
| 3,134,583 | A | 5/1964 | Wilson |
| 3,202,157 | A | 8/1965 | Touton |
| 3,233,339 | A | 2/1966 | Long et al. |
| 3,251,620 | A | 5/1966 | Hassler |
| 3,394,709 | A | 7/1968 | Remer |
| 3,494,723 | A | 2/1970 | Gray |
| 3,494,724 | A | 2/1970 | Gray |
| 3,503,137 | A | 3/1970 | Wilson |
| 3,664,034 | A | 5/1972 | Wilson |
| 3,669,429 | A | 6/1972 | Dew |
| 3,699,976 | A | 10/1972 | Abe et al. |
| 3,773,055 | A | 11/1973 | Stungis et al. |
| 3,785,384 | A | 1/1974 | Sylvester et al. |
| 3,845,774 | A | 11/1974 | Tso et al. |
| 3,870,053 | A | 3/1975 | Heitkamp et al. |
| 3,877,468 | A | 4/1975 | Lichtneckert et al. |
| 3,899,836 | A | 8/1975 | Johnson |
| 3,901,248 | A | 8/1975 | Lichtneckert et al. |
| 3,927,683 | A | 12/1975 | Wilson et al. |
| 3,932,946 | A | 1/1976 | Johnson |
| 3,937,227 | A | 2/1976 | Azumano |
| 4,036,454 | A | 7/1977 | Jordan et al. |
| 4,045,066 | A | 8/1977 | Griffin et al. |
| 4,099,338 | A | 7/1978 | Mullin et al. |
| 4,114,288 | A | 9/1978 | Fowler |
| 4,123,221 | A | 10/1978 | Danford |
| 4,156,431 | A | 5/1979 | Epstein et al. |
| 4,178,946 | A | 12/1979 | Knight |
| 4,192,323 | A | 3/1980 | Horne |
| 4,206,554 | A | 6/1980 | Fowler |
| 4,212,634 | A | 7/1980 | Mitchell et al. |
| 4,247,992 | A | 2/1981 | MacGregor |
| 4,263,721 | A | 4/1981 | Danford |
| 4,301,817 | A | 11/1981 | Keritsis |
| 4,317,837 | A | 3/1982 | Kehoe et al. |
| 4,355,648 | A | 10/1982 | Bokelman et al. |
| 4,364,401 | A | 12/1982 | Keritsis |
| 4,424,024 | A | 1/1984 | Wilson et al. |
| 4,430,806 | A | 2/1984 | Hopkins |
| 4,470,422 | A | 9/1984 | Joubert et al. |
| 4,482,315 | A | 11/1984 | Day |
| 4,483,353 | A | 11/1984 | Mitchell |
| 4,499,911 | A | 2/1985 | Johnson |
| 4,556,073 | A | 12/1985 | Gravely et al. |
| 4,557,057 | A | 12/1985 | Weiss et al. |
| 4,557,280 | A | 12/1985 | Gravely et al. |
| 4,559,956 | A | 12/1985 | DeLange et al. |
| 4,566,469 | A | 1/1986 | Semp et al. |
| 4,572,219 | A | 2/1986 | Gaisch et al. |

(Continued)

FOREIGN PATENT DOCUMENTS

| | | |
|---|---|---|
| CA | 1026186 | 2/1978 |

(Continued)

OTHER PUBLICATIONS

International Search Report mailed Jan. 27, 2010 for PCT/US2009/066495.
Report on 2010 Curing Results dated Feb. 2011 (17 pages).
Book entitled Drying Farm Crops, Carl W. Hall, Agricultural Consulting Associates, Inc. (1957).
DeCloet Bulk Curing Kilns. (Apr. 1971).
Cundiff, J.S. Exchanged Air Control for Maximum Solar Energy Utilization in Tobacco Curing, American Society of Agricultural Engineers, John S. Cundiff, vol. 26, No. 1 pp. 260-264 (1983).
Suggs, C.W. et al., Pressure versus air flow through fresh tobacco leaves, American Society of Agricultural Engineers, Transactions of ASAE, vol. 28, No. 5, pp. 1664-1667. (1985).
Manual entitled Powell Manufacturing, Co. Bulk Curing/Drying Owner's/Operator's Manual for Flue Cured Tobaccos, Powell Manufacturing, Co. (Jan. 20, 1988).
Skillman, Laura, Messenger-Inquirer article entitled, Glenn Farm Tests Swedish Method for Curing Tobacco. (Aug. 5, 1990).
Abstracts presented at Coresta Agronomy & Phytopathology Meeting, Louisville, Kentucky. (Oct. 15, 1991-Oct. 18, 1991).

(Continued)

*Primary Examiner* — Richard Crispino
*Assistant Examiner* — Phu Nguyen
(74) *Attorney, Agent, or Firm* — Banner & Witcoff, Ltd.

(57) ABSTRACT

A method of curing tobacco comprises drying a harvested tobacco plant in a controlled environment for a time sufficient to substantially prevent the formation of at least one nitrosamine. The tobacco is first subjected to the controlled environment while at least a majority of the tobacco is in a green state. The resulting cured tobacco usually has tobacco-specific nitrosamine (TSNA) levels which are undetectable and are similar to levels found in freshly harvested, green tobacco.

26 Claims, No Drawings

U.S. PATENT DOCUMENTS

| | | | | |
|---|---|---|---|---|
| 4,590,954 | A | 5/1986 | Gooden | |
| 4,620,556 | A | 11/1986 | Rosson et al. | |
| 4,622,982 | A | 11/1986 | Gaisch et al. | |
| 4,640,299 | A | 2/1987 | Ono et al. | |
| 4,651,759 | A | 3/1987 | Uydess | |
| 4,685,478 | A | 8/1987 | Malik et al. | |
| 4,709,708 | A | 12/1987 | Kagawa | |
| 4,709,710 | A | 12/1987 | Gaisch et al. | |
| 4,756,317 | A | 7/1988 | Edwards | |
| 4,788,989 | A | 12/1988 | Nambu et al. | |
| 4,790,335 | A | 12/1988 | Marley et al. | |
| 4,802,498 | A | 2/1989 | Ogren | |
| 4,805,642 | A | 2/1989 | Rainer | |
| 4,821,747 | A | 4/1989 | Stuhl et al. | |
| 4,836,222 | A | 6/1989 | Livingston | |
| 4,874,000 | A | 10/1989 | Tamol et al. | |
| 4,898,189 | A | 2/1990 | Wochnowski et al. | |
| 4,906,274 | A | 3/1990 | Mattox | |
| 4,907,605 | A | 3/1990 | Ray et al. | |
| 5,018,281 | A | 5/1991 | Bullock, Jr. | |
| 5,023,376 | A | 6/1991 | Shehad et al. | |
| 5,125,420 | A | 6/1992 | Livingston | |
| 5,127,934 | A | 7/1992 | Mattox | |
| 5,139,035 | A | 8/1992 | Lasch et al. | |
| 5,335,590 | A | 8/1994 | Crump, III et al. | |
| 5,372,149 | A | 12/1994 | Roth et al. | |
| 5,383,445 | A | 1/1995 | Dixon | |
| 5,431,175 | A | 7/1995 | Beckett et al. | |
| 5,488,962 | A | 2/1996 | Perfetti | |
| 5,515,775 | A | 5/1996 | Crump, III et al. | |
| 5,560,376 | A | 10/1996 | Meiring et al. | |
| 5,685,710 | A | 11/1997 | Sagrera et al. | |
| 5,791,353 | A | 8/1998 | Junemann et al. | |
| 5,803,081 | A | 9/1998 | O'Donnell et al. | |
| 5,810,020 | A | 9/1998 | Northway et al. | |
| 6,135,121 | A | 10/2000 | Williams | |
| 6,202,649 | B1 * | 3/2001 | Williams | 131/303 |
| 38,123 | A1 | 5/2003 | Williams | |
| 6,805,134 | B2 | 10/2004 | Peele | |
| 6,834,654 | B2 * | 12/2004 | Williams | 131/352 |
| 6,895,974 | B2 | 5/2005 | Peele | |
| 7,377,280 | B2 | 5/2008 | Bokelman et al. | |
| 7,404,406 | B2 | 7/2008 | Peele | |
| 7,452,541 | B2 | 11/2008 | Bachmann et al. | |
| 2001/0000386 | A1 | 4/2001 | Peele | |
| 2005/0109357 | A1 | 5/2005 | Williams | |

FOREIGN PATENT DOCUMENTS

| | | |
|---|---|---|
| DE | 1767677 | 11/1971 |
| DE | P 3904169.7 | 8/1990 |
| GB | 706052 | 3/1954 |
| GB | 1484663 | 9/1977 |
| GB | 2064294 | 6/1981 |
| GR | 86.2434 | 10/1986 |
| JP | 51-133495 | 11/1976 |
| JP | 51-144535 | 11/1976 |
| JP | 54-157898 | 12/1979 |
| JP | S56-19224 | 5/1981 |
| JP | S56-44707 | 10/1981 |
| JP | S58-104483 | 6/1983 |
| KR | 1994-00013396 | 7/1994 |
| WO | 94/07382 | 4/1994 |
| WO | 98/05226 | 2/1998 |
| WO | 98/58555 | 12/1998 |
| WO | 00/15056 | 3/2000 |

OTHER PUBLICATIONS

Presentation entitled Model for Flue Cured Production in Greece, Presented at Coresta Agronomy & Phytopathology Meeting, Louisville, Kentucky by Hadzistavros, S.C. et al. (Oct. 17, 1991).

Manual entitled Vencon-Varsos SA Three Tier Barn Assembly Manual. (1992).

Manual entitled Ventolab 6, 1993 Model, Operator's Manual. (1993).

Manual entitled Ventobacco Company Ventolab 6 Operator's Manual, Ventobacco Company, Turkey 1993.

Manual entitled Ventobacco Company Ventolab 6 1993 Model Operator's Manual, Ventobacco Company (1993).

Manual entitled Ventobacco Company Bulk Curing Barns Operator's Manual, Ventobacco Company, Turkey 1993.

Manual entitled Ventobacco Company Ventolab 6 operator's manual, Ventobacco Company, U.S.A. 1994.

Manual entitled Ventobacco Company Ventolab 6 Operator's Manual, Ventobacco Company, U.S.A. 1994 (DTX-2356).

Manual entitled Ventobacco Company Bulk Curing Barns Operator's Manual, Ventobacco Company, Jordan 1994.

Manual entitled Ventobacco Company Ventolab 6 operator's manual, Ventobacco Company, U.S.A. 1994 (DTX-1869).

Slide presentation entitled Chemical and Microbiological Changes During Flue Curing of NK-149 Tobacco, Presented at 48th Tobacco Chemists Research Conference, Greensboro, NC by Jackie Greene and William Caldwell. (Sep. 27, 1994) (DTX-0014).

Slide presentation entitled Chemical and Microbiological Changes During Flue Curing of NK-149 Tobacco, Presented at 48th Tobacco Chemists Research Conference, Greensboro, NC by Jackie Greene and William Caldwell. (Sep. 27, 1994) (DTX-0015).

Slide presentation entitled Chemical and Microbiological Changes During Flue Curing of NK-149 Tobacco, Presented at 48th Tobacco Chemists Research Conference, Greensboro, NC by Jackie Greene and William Caldwell (Sep. 27, 1994) (DTX-0016).

Slide presentation entitled Chemical and Microbiological Changes During Flue Curing of NK-149 Tobacco, Presented at 48th Tobacco Chemists Research Conference, Greensboro, NC by Jackie Greene and William Caldwell (Sep. 27, 1994) (DTX-0017).

Slide presentation entitled Chemical and Microbiological Changes During Flue Curing of NK-149 Tobacco, Presented at 48th Tobacco Chemists Research Conference, Greensboro, NC by Jackie Greene and William Caldwell (Sep. 27, 1994) (DTX-2343).

Manual entitled Ventobacco Company Bulk Curing Barns Operator's Manual, Ventobacco Company. (1995).

Long Generation II Easi-Cure Tobacco Barn Advertisement in May 15, 1995 issue of Flue Cured Tobacco (May 15, 1995).

Fax dated Jan. 16, 1996 regarding TSNA data analysis from Inger Wahlberg to Brian William Smeeton. (Jan. 16, 1996).

Walker, E.K. et al., Curing Flue-Cured Tobacco in Canada. Research Station, Delhi, Ontario (1997).

Manual entitled Ventobacco Company Curing Computer VK 961 Operator's Manual, Ventobacco Company. (1997).

Manual entitled Ventobacco Company Bulk Curing Barns Operator's Manual, Ventobacco Company, China 1997.

E-mail dated May 30, 1997 regarding TSNA test results from Richard Reich to Gary Hellmann, Michael Morton, Fred Wedelboe, Joeffery Scott Gentry, Timothy Brian Nestor, David Peele, Gary Shelar, Brian William Smeeton, Daniel Layten Davis and J. Lawson.

TSNA analysis of Chinese cigarettes dated Aug. 20, 1997 performed by Harold Burton.

Program of 1997 Agro-Phyto Meeting, Montreux, Switzerland. (Oct. 6, 1997-Oct. 9, 1997).

Slide presentation entitled The Role of Nitrite in the Accumulation of TSNAs in Tobacco, Presented at 1997 Agro-Phyto Meeting, Montreux, Switzerland. (Oct. 6, 1997).

Manual entitled Vencon-Varsos SA Ventobacco Company Bulk Curing Barns Operator's Manual, Ventobacco Company, Turkey (1998).

Manual entitled Vencon-Varsos SA Ventobacco Company Bulk Curing Barns Operator's Manual, Ventobacco Company, Poland (1998).

Abstract entitled Airflow in Big Box Flue Cured Tobacco Barns, David Peele, Coresta, 1998. (Mar. 31, 1998).

Faxes between David Peele and George Varsos, including attached Ventobacco 3 Tier Upflow Barn Brochure including LPG or Natural Gas Burner with Heat Exchanger (May 12, 1998).

Selected File History Excerpts from U.S. Appl. No. 08/757,104, Tobacco and Related Products, filed Dec. 2, 1996, issued as U.S. Patent 5,803,081 on Sep. 8, 1998. Jonnie Williams and Francis O'Donnell inventors. (Sep. 8, 1998).

U.S. Appl. No. 60/023,205, Microwavable Improved Tobacco and Related Products, filed Aug. 5, 1996, abandoned, Jonnie Williams and Francis O'Donnell inventors. (Sep. 8, 1998).

Selected File History Excerpts from U.S. Appl. No. 08/725,691, Improved Tobacco and Related Products, filed Sep. 21, 1996, abandoned, Jonnie Williams and Francis O'Donnell inventors (Sep. 8, 1998).

Selected File History Excerpts from U.S. Appl. No. 08/739,942, Improved Tobacco and Related Products, filed Oct. 30, 1996, abandoned, Jonnie Williams and Francis O'Donnell inventors (Sep. 8, 1998).
Manual entitled Ventobacco Company Bulk Curing Barns Operator's Manual, Ventobacco Company, USA 1999.
Press release entitled R.J. Reynolds Tobacco Company Tobacco Discloses Potential Method to Reduce Controversial Compounds in Flue-cured Tobacco. (Apr. 29, 1999).
Program of the 1999 Meeting of the Smoke and Technology Study Groups, Innsbruck, Austria, Sep. 5-9, 1999.
Abstracts of Presentations Made at the 1999 Coresta Joint Meeting of the Smoke and Technology Study Groups (Sep. 5, 1999-Sep. 9, 1999).
Slide presentation entitled The Development of Low TSNA Air-Cured Tobaccos, II. Effects of Curing Conditions and Post-Curing Drying on TSNA Formation Presented by R. Long, I. Wahlberg, P. Brandt, and A. Wiernick at the 1999 Coresta Joint Meeting of the Smoke and Technology Study Groups, Innsbruck, Austria. (Sep. 6, 1999).
Slide presentation entitled Formation of Tobacco Specific Nitrosamines in Flue-Cured Tobacco, delivered by David Peele on Sep. 6, 1999 in Innsbruck, Austria, Sep. 15, 1999 in Montreal, Canada, and Oct. 13, 1999 in Suzhou, China (Sep. 6, 1999-Oct. 13, 1999).
Fax from Harold Burton to Jerome Jaffe, dated Nov. 5, 1999, including a 1999 publication entitled: Smokeless Tobacco by Inger Walhberg.
Photograph of crops drying building on Spindletop farm taken on Sep. 4, 2002.
Expert Report of Richard Higby (Higby 1) (Feb. 14, 2003).
R.J. Lee supporting data from CD 1 (various) (DTX-2318).
Matuo, S. and M. Tetsuji, Wide Area Perfect Cooperative Drying, Leaf Tobacco Research, No. 111, pp. 10-19, including translation attached to Japanese language version. (Oct. 1989).
Sumner, J.E. and J.S. Cundiff, Guidelines for Temperature, Humidity, and Airflow Control in Tobacco Curing, University of Georgia College of Agriculture Experiment Stations, Research Bulletin 299. (May 1983).
Tricker, A.R. et al., The Occurrence of N-Nitro Compounds in Zarda Tobacco, Cancer Letters, vol. 42, pp. 113-118. (1988).
Tricker, A.R. et al., The Occurrence of N-nitroso Compounds in Kiwam tobacco, Cancer Letters, vol. 49, pjp. 221-224. (1989).
Tricker, A.R., R. Haubner, B. Spiegelhalder and R. Preussmann, The Occurrence of Tobacco-Specific Nitrosamines in Oral Tobacco Products and Their Potential Formation Under Simulated Gastric Conditions, Fd. Chem. Toxic. vol. 26, No. 10, pp. 861-865. (1988).
Tso, T.C. et al., Some Agronomic Factors Affecting N-Dimethyl Nitrosamine Content in Cigarette Smoke, Beitrage zur Tabakforschung, vol. 8, No. 1, pp. 34-38. (Jan. 1975).
Walker, E.K., Bulk Curing Studies with Flue-Cured Tobacco, Lighter, vol. 32, pp. 25-31. (1962).
Walker, E.K., Effect of Relative Humidity in Yellowing Flue-Cured Tobacco Under Forced-Air Conditions, Lighter, vol. 35, pp. 16-21. (1965).
Zumft, W.G., Cell Biology and Molecular Basis of Denitrification, Microb. Mol. Biol. Rev., vol. 61, No. 4, pp. 533-616. (Dec. 1997).
TSNA sample data from Sep. 1, 1998-Sep. 23, 1998. (DDX 7) (Sep. 1998).
TSNA sample data from Sep. 1, 1998-Sep. 23, 1998 (DDX 8) (Sep. 1998).
TSNA sample data from Sep. 1, 1998-Nov. 12, 1998 (DDX 55) (Dec. 1998).
TSNA sample data (1996-1998) (PDX 190).
TSNA sample data (Mar. 2001) (DDX 27).
Brochure entitled IF Series Indirect Fired from Dayco, Inc. (undated).
Manual entitled Powell Manufacturing, Co.'s "77-514" and "77-771" Erection Instructions, Sep. 10, 1970.
Manual entitled Powell Manufacturing, Co. Bulk Curing Owner/Operators Manual, Jan. 17, 1979.
Manual entitled Powell Manufacturing, Co.'s Bulk Curing/Drying Owner's/Operator's Manual for Flue Cured Tobaccos, Powell Manufacturing, Co. (Jan. 20, 1988).
Manual entitled Powell Manufacturing, Co. Bulk Curing Tobacco Barn Owner/Operator Manual, Powell Manufacturing, Co., Feb. 1, 1992.
Manual entitled Ventobacco Company 84 Rack Curing Barn, Ventobacco Company, Jordan, 1992.
Manual entitled Ventobacco Company Ventolab 6 Operator's Manual, Ventobacco Company, Cyprus, 1992.
Manual entitled Ventobacco Company Bulk Curing Barns Operator's Manual, Ventobacco Company, Poland, 1993.
Manual entitled Ventobacco Company Curing Computer VK 961 Operator's Manual, 1997.
Brochure entitled Long Manufacturing Company Generation II Easi-Cure Tobacco Barn (BAW-017853-7) (undated).
Brochure entitled Long Manufacturing Company Generation II Easi-Cure Tobacco Barn (RCT-001656-9) (undated).
Manual entitled VCU Ventobacco Company Curing Unit, Ventobacco Company (1999).
Manual entitled Ventobacco Company Curing Computer VK 981 Operators Manual, 1998.
Product specifications for Direct Drive Tubeaxial Fans from Aerovent, Inc. (undated).
Defendants R. J. Reynolds Tobacco Company's "Notice of Disclosure of Prior Art Pursuant to 35 U.S.C. § 282," filed in the U.S. District Court of Maryland, Civil Action 01-1504, dated Apr. 16, 2009, 62 pages.
Plaintiff "Star Scientific, Inc.'s Combined Motion in Limine to Exclude Privileged Documents and Related Testimony and Motion to Compel Return of All Privileged Documents Ordered to be Produced Pursuant to the Crime-Fraud Exception," filed in the U.S. District Court of Maryland, Civil Action 01-1504, dated Mar. 10, 2009, 69 pages.
Parsons, L.L., Smith, M.S., Hamilton, J.L., and Mackown, C.T., "Nitrate Reduction During Curing and Processing of Burley Tobacco," Tobacco Science 100, (Sep. 5, 1986), pp. 48-52.
Defendants R. J. Reynolds Tobacco Company's "Reply in Support of Defendants' Motion in Limine No. 6: To Preclude Star from Introducing Evidence or Argument Relying on Sep. 15, 1998, As the Effective Filing Date for the Parents-in-Suit", filed in the U.S. District Court of Maryland, Civil Action 01-1504, dated Mar. 3, 2009, 4 pages.
Plaintiff "Star Scientific's Opposition to Defendants' Motion in Limine No. 6 Regarding the Effective Filing Date of the Patents-in-Suit," filed in the U.S. District Court of Maryland, Civil Action 01-1504, dated Feb. 17, 2009, 12 pages.
Defendants R. J. Reynolds Tobacco Company's "Defendants' Motion in Limine No. 6: To Preclude Star From Introducing Evidence or Argument Relying on Sep. 15, 1998, As the Effective Filing Date for the Patents-In-Suit", filed in the U.S. District Court of Maryland, Civil Action 01-1504, dated Jan. 30, 2009, 3 pages.
Letter filed at the U.S. Patent and Trademark Office on Nov. 7, 2002 in U.S. Patent 6,425,401, 3 pages.
American Society of Agricultural Engineers, Exchanged Air Control for Maximum Solar Energy Utilization in Tobacco Curing, pp. 260-264, 1983.
Walker, E.K., Fixing the Color of Flue-Cured Tobacco Under Forced Air Conditions, Tobacco Science, 1-7 (1965).
Declaration of Harold R. Burton, Ph.D. with Exhibits A-H as follows: (A) Data from QD, FD, MW Sample Testing/1993 Study. (B) Data from QD and FD Sample Testing/1994 Study. (C) Progress Report/Undated. (D) CORESTA Conference, Agronomy & Phytopathology Joint Meeting, Reunion Commune Des Groupes Agronomie.
H.R. Burton et al., "Changes in Chemical Composition of Burley Tobacco during Senscence and Curing. 3. Tobacco-Specific Nitrosamines", J. Agric. Food Chem., 1989, 37, pp. 426-430.
Program 49th Tobacco Chemists' Research Conference, 1995, vol. 49, Lexington, Kentucky, p. 38.
Letter from Paul L. Perito to Dr. Bertold Spiegelhalder dated Apr. 2, 2001.

Email communication from Dr. Bertold Spiegelhalder to Paul L. Perito dated May 31, 2001.
Technology Agriculture, 1995, pp. 146-148.
W.J. Chamberlain et al., Levels of N-nitrosonornicotine in Tobaccos Grown Under Varying Agronomic Conditions, Tobacco International, (1984) vol. 186, No. 26, pp. 111-113.
Defendant R.J. Reynolds Tobacco Company's Amended and Supplemental Responses to Plaintiff's First Set of Interrogatories, filed in the U.S. District Court of Maryland, Civil Action 01-1504, dated Feb. 22, 2002, 23 pages.
Defendant R.J. Reynolds Tobacco Company's Responses to Plaintiff's First Set of Interrogatories, *Star Scientific, Inc.* v. *R. J. Reynolds Tobacco Company*, Civil Action AW-01-1504 (U.S. District Court of Maryland), Dec. 24, 2001.
Civil Docket for Case #: 8:01-cv-01504-MJG; *Star Scientific* v. *R.J. Reynolds*, et al. in U.S. District Court, District of Maryland (Greenbelt) (undated).
Civil Docket for Case #: 8:02-cv-02504-MJG; *Star Scientific* v. *R.J. Reynolds*, et al. in U.S. District Court, District of Maryland (Greenbelt) (undated).
Defendant R.J. Reynolds Tobacco Company's Motion for Summary Judgment of Invalidity Based on 35 U.S.C. § 101, filed in the U.S. District Court of Maryland, Civil Actions 01-1504 and 02-2504, dated Jan. 30, 2009, 49 pages.
Plaintiff Star Scientific Inc.'s Reply in Support of Defendants' Motion for Summary Judgment of Invalidity Under 35 U.S.C. § 101, filed in the U.S. District Court of Maryland, Civil Actions 01-1504 and 02-2504, dated Mar. 3, 2009, 6 pages.
44th Tobacco Chemists' Research Conference, Winston Salem, NC, Program Booklet and Abstracts, vol. 44, pp. 32-33 (Sep. 30, 1990).
53rd Tobacco Science Research Conference, Montreal, Quebec, Canada, Program Booklet and Abstracts, vol. 53, pp. 68-69. (Sep. 12, 1999).
Adams, J.D. et al., Short Paper: Tobacco-Specific N-Nitrosamines in Dry Snuff, Fd Chem. Toxic., vol. 25, No. 3, pp. 245-246. (1987).
Aerovent XTM Curer brochure. (STURGILL 002321-002322; Sturgill-7) (1970s).
Abstracts by Peele, D.M., Chemical and Biochemical Changes During the Flue-curing of Tobacco, Bush, L., Origin of Nitrite-Nitrogen for Tobacco-Specific N-nitrosamine formation, Teague, R.V., New Curing System for Fuel, Electricity and Labour Savings in Thailand, Coresta Meet. Agro-Phyto Groups, pp. 146-148. (1995).
Andersen, R.A. et al., Accumulation of 4-(N-Methyl-N-nitrosamino)-1-(3-pyridyl)-1-butanone in Alkaloid Genotypes of Burley Tobacco During Postharvest Processing: Comparisons with N' Nitrosonornicotine and Probable Nitrosamine Precursors, Cancer Research, vol. 45, pp. 5287-5293. (1985).
Andersen, R.A. et al., Changes in Chemical Composition of Homogenized Leaf-Cured and Air-Cured Burley Tobacco Stored in Controlled Environments. American Chemical Society, J. Agric. Food Chem., vol. 30, pp. 663-668. (1982).
Andersen, R.A., et al., Effects of Air-Curing Environment on Alkaloid Derived Nitrosamines in Burley Tobacco, U.S. Department of Agriculture and College of Agriculture, University of Kentucky, Lexington, KY, pp. 451-455. (undated).
Atawodi, S.E. et al., Tobacco-specific nitrosamines in some Nigerian cigarettes, Cancer Letters, No. 97. pp. 1-6 (1995).
Becker, S., O2 as the Regulatory Signal for FNR-Dependent Gene Regulation in *Escherichia coli*, J. Bacteriol., vol. 178, No. 15, pp. 4515-4521 (Aug. 1996).
Bhide, S.V. et al., Tobacco-specific N-Nitrosamines [TSNA] in Green Mature and Processed Tobacco Leaves from India, Beitrage zur Tabakforschung International, vol. 14, No. 1, pp. 29-32 (Dec. 1987).
Bhide, S.V. et al., Tobacco-Specific N-Nitrosamines in Green Mature Tobacco Leaves and its Progressive Increase on Drying and Processing. (undated).
Boyette, M.D. and C.W. Suggs, Mechanization, Flue-Cured Tobacco 1992 Information. (1992).
Brunnemann, K. et al., Analytical Studies on N-Nitrosamines in Tobacco and Tobacco Smoke, 45th Meeting of the Tobacco Chemists' Research Conference, Asheville, North Carolina, Recent Advances in Tobacco Science, vol. 17, pp. 71-112. (Oct. 1991).
Brunnemann, K. et al., Analytical Studies on N-Nitrosamines in Tobacco and Tobacco Smoke, Toxicology, vol. 21, issue 4, pp. 235-240. (1991).
Brunnemann, K. et al., N-Nitrosamines in Chewing Tobacco: An International Comparison, J. Agric. Food Chem., vol. 33, pp. 1178-1181. (1991).
Brunnemann, K. et al., Role of Tobacco Stems in the Formation of N-Nitrosamines in Tobacco and Cigarette Mainstream and Sidestream Smoke, American Chemical Society, J. Agric. Food Chem., vol. 31, No. 6, pp. 1221-1224. (1983).
Bunn, J.M., et al., Environmental Design of a New Burley Curing Barn, Tobacco Science, XVII, pp. 1-5. (Jun. 22, 1973).
Burton, H. et al., Changes in Chemical Composition of Tobacco Lamina During Senescense and Curing. 1. Plastic Pigments, J. Agric. Food Chem., vol. 33, pp. 879-883. (1985).
Burton, H. et al., Distribution of Tobacco Constituents in Tobacco Leaf Tissue. 1. Tobacco-Specific Nitrosamines, Nitrate, Nitrite, and Alkaloids, J. Agric. Food Chem., 40, p. 1050-1055. (1992).
Burton et al., Influence of Temperature and Humidity on the Accumulation Tobacco-Specific Nitrosamines in Stored Burley Tobacco, J. Agric. Food Chem., vol. 37, No. 5, pp. 1372-1377. (1989).
Burton, H. et al., Relationship between Tobacco-Specific Nitrosamines and Nitrite from Different Air-Cured Tobacco Varieties, J. Agric. Food Chem., vol. 42, No. 9, pp. 2007-2011. (1994).
Burton, H., Influence of Rapid Drying of Dark Tobacco during Curing on the Accumulation of Tobacco-Specific Nitrosamines (TSNA) and Nitrite, Progress Report submitted to Swedish Tobacco (1994).
Burton, H. et al., Abstract entitled Reduction of Nitrite-Nitrogen and Tobacco N'-Specific Nitrosamines in air-cured tobacco by elevating drying temperatures, CORESTA 1995.
Burton, H. overheads summarizing the 1993 Quick Drying, Freeze Drying and Microwave testing, presented at CORESTA 1995.
Burton, H. overheads summarizing the 1994 Quick Drying and Freeze Drying testing, presented at CORESTA 1995.
Carter et al., Soil and Sediment Bacteria Capable of Aerobic Nitrate Respiration, Appl. Environ. Microbiol., vol. 61, No. 8, pp. 2852-2858. (Aug. 1995).
Case, P.D. et al., The Effect of Curing Techniques on the Nitrosamine Content of Tobacco: A Preliminary Study, Group Research and Development Centre, Oct. 13, 1983.
Chamberlain et al., Effects of Curing and Fertilization on Nitrosamine Formation in Bright and Burley Tobacco, Phytochemical Research Unit, USDA, Agricultural Research Service, Beitrage zur Tabakforschung International, vol. 15, No. 2, pp. 87-92. (Apr. 1992).
Chamberlain et al., Levels of N-nitrosonornicotine in Tobaccos Grown under Varying Agronomic Conditions, Tobacco International, vol. 186, No. 26, pp. 156-158 (1984).
Chamberlain et al., Studies on the Reduction of Nitrosamines in Tobacco, Tobacco International, vol. 188, No. 16, pp. 38-39. (1986).
Chamberlain, W.J., O.T. Choritk, J.L. Baker and T.G. Sutton, Curing Effects on Contents of Tobacco-Specific Nitrosamines in Bright and Burley Tobaccos, 41st TCRC, No. 53, 1987.
Cooper et al., Drying and Curing Bright Leaf Tobacco with Conditioned Air, Industrial Engineering Chemistry, vol. 32, pp. 194-198 (Feb. 1940).
Cui, M. et al., Factors in Tobacco-Specific n-Nitrosamine Accumulation in Tobacco,TCRC No. 5074, 1996, Philip Morris Conference InfoBase. (1996).
Cundiff, J. et al., Energy Model for Forced Air Tobacco Curing, Transactions of the ASAE, vol. 24, No. 1, pp. 211-215 (1981).
Cundiff, J.S., Fan Cycling and Energy Consumption in Bulk Tobacco Curing, The University of Georgia Agriculture Experiment Stations, Research Report 288, pp. 3-29. (Jul. 1978).
Cundiff, J.S., Containerized Curing of Tobacco, 1974 Winter Meeting of the American Society of Agricultural Engineers, Chicago, Illinois, Dec. 10-13, 1974, pp. 1-19. (Dec. 1974).
Cundiff, John S., Effect of Exchange Air Rate on Energy Efficiency in Tobacco Curing, 1980 Winter Meeting of the American Society of Agricultural Engineers, Chicago, Illinois, Dec. 2-5, 1980.
Davis, D. Layten and M.T. Nielsen (eds.), Tobacco Production, Chemistry and Technology, Blackwell Science Ltd., Oxford, UK., pp. 129 and 132 (undated).

Dixon, M. et al., Enzymes, Dixon, M. and Edwin C. Webb (eds), Second Edition, American Press, New York, pp. 144-151. (1964).
Djordjevic, M. et al., Tobacco-Specific Nitrosamine Accumulation and Distribution in Flue-Cured Tobacco Alkaloid Isolines, J. Agric. Food Chem., vol. 37, No. 3, pp. 752-756 (1989).
Djordjevic, M.V. et al., Tobacco-Specific Nitrosamine Accumulation in Different Genotypes of Burley Tobacco at Different Stages of Growth and Air-Curing, 41st Tobacco Chemists' Research Conference. (1987).
Duncan, George A., Using Fans in Conventional Burley Barns, University of Kentucky Cooperative Extension Service, AEN-69. (Apr. 1992).
Fischer, S. et al., Exposure to Tobacco-specific Nitrosamines by the Different Habits of Tobacco Use, Examination of Transfer Rates and the Influence of Smoking Habits, from website www.dkfz-heidelberg.de, printed Feb. 14, 2001.
Fischer, S. et al., Investigations on the Origin of Tobacco-Specific Nitrosamines in Mainstream Smoke of Cigarettes, Carcinogenesis vol. 11, No. 5, pp. 723-730. (1990).
Fischer, S. et al., No Pyrosynthesis of N'-Nitrosonornicotine (NNN) and 4-(Methylnitrosamino)-1-(3-Pyridyl)-1-Butanone (NNK) from Nicotine, Advances in Pharmacological Sciences, pp. 103-107. (1995).
Fischer, S. et al., Preformed Tobacco-Specific Nitrosamines in Tobacco Role of Nitrate and Influence of Tobacco Type, Carcinogenesis, vol. 10, No. 8, pp. 1511-1517 (1989).
Fischer, S. et al. Tobacco-Specific Nitrosamines in Canadian Cigarettes, J. Cancer Res. Clin. Oncol., vol. 116, pp. 563-568. (1990).
Fischer, S. et al., Tobacco-Specific Nitrosamines in European and USA cigarettes, Archiv für Geschwulstforschung, vol. 60, No. 3, pp. 169-177. (1990).
Fisher, Brandy, Curing the TSNA Problem, Tobacco Reporter. (Aug. 2000).
R.J. Lee supporting data from CD 2 (various) (DTX-2319).
Wiernik et al., "Effect of Air-Curing on the Chemical Composition of Tobacco," Recent Advances in Tobacco Science, vol. 21, Symposium Proceedings, Tobacco Chemists' Research Conference, 49th Meeting Sep. 24-27, 1995 (pp. 38-81).
Scanlan et al., "N-Nitrosodimethylamine in Nonfat Dry Milk," Chapter 3, Oregon State University, Corvallis, OR, American Chemical Society (1994).
David M. Peele, "Chemical and Biochemical Changes During the Flue-Curing of Tobacco," Recent Advances in Tobacco Science, vol. 21, Symposium Proceedings, Tobacco Chemists' Research Conference, 49th Meeting, Sep. 24-27, 1995 (pp. 80-133).
Willie Denton, Mgr., Long Equip. Co., "Generation II Easi-Cure Tobacco Barn [product information]," Tarboro, NC., 1998 (4 pages).
Harold R. Burton, Letter to Ron Delmendo—patent attorney ("Burton Letter"), University of Kentucky, Department of Agronomy, Lexington, KY, Aug. 28, 1998 (2 pages).
Hackh's Chemical Dictionary (3rd ed.), Julius Grant, M.Sc, PhD., F.R.I.C. (ed.) Definition of "anaerobic," The McGraw-Hill Book Company, Inc., p. 54 (1944).
Webster's Ninth New Collegiate Dictionary, Merriam-Webster Inc., Definitions of "anaerobic," "formation" and "prevent," pp. 82, 485, 933 (1986).
Farmtrac may be sold: South Korean firm makes offer, Business Week, from The Daily Southerner, Tarboro, NC, Dec. 29, 2008 (4 pages).
Bob Benedetti, "Farmtrac tries to regroup," The Daily Southerner, Tarboro, NC, Jan. 18, 2008 (2 pages).
Bob Benedetti, "Farmtrac tries to regroup," The Daily Southerner, Tarboro, NC, Dec. 29, 2008 (2 pages).
Richard N. Loeppky and Christopher J. Michejda (eds.), "Nitrosamines and Related N-Nitroso Compounds," developed from a symposium sponsored by the Division of Agricultural and Food Chemistry at the 204th National Meeting of the American Chemical Society, Washington, D.C., Aug. 23-28, 1992, ACS Symposium Series, vol. 553 (7 pages).
Star Scientific's Response to Defendant's Ninth Set of Interrogatories to Plaintiff (No. 40), *Star Scientific, Inc.* v. *R.J. Reynolds Tobacco Co.*, Case No. AW 01-CV-1504, Sep. 4, 2002 (7 pages).
A.G. Tobling—Withers & Rogers, Letter to European Patent Office correcting airflow disclosure in App. No. 99948191.4, based on PCT/US99/20909, Dec. 16, 2002 (4 pages).
Excerpt of Deposition of Jonnie R. Williams (transcript) ("on the flip-side testimony"), *Star Scientific* v. *R.J. Reynolds Tobacco Co.*, Case No. AW 01-CV-1504, Jul. 15, 2002 (3 pages).
Daubert Hearing before Hon. Marvin J. Garbis, re exclusion of Star's expert—R.J. Lee (transcript), *Star Scientific* v. *R.J. Reynolds Tobacco Co.*, Case No. AW 01-CV-1504, Dec. 30, 2004 (96 pages).
Timothy Nelson, Ph.D.—Star Scientific's Expert, Rebuttal Report in response to Dr. Otten's Report, *Star Scientific* v. *R.J. Reynolds Tobacco Co.*, Case No. AW 01-CV-1504, Feb. 19, 2003 (10 pages).
James D. Sturgill—Star Scientific's Expert, Rebuttal Report in response to Dr. Otten's Report, *Star Scientific* v. *R.J. Reynolds Tobacco Co.*, Case No. AW 01-CV-1504, Feb. 20, 2003 (8 pages).
RJ Lee Group, Inc., "RJ Lee Group Expert Report," prepared for Crowell & Moring, LLP (counsel for Star Scientific), Project: LSH 103586, Monroeville, PA, Jan. 31, 2003 (125 pages).
Hon. Alexander Williams, Jr. Order adopting the Special Master's Report and Recommendations in toto and denying RJR's motion for summary judgment for indefiniteness under 35 U.S.C. § 112, ¶2, *Star Scientific* v. *R.J. Reynolds Tobacco Co.*, Case No. AW 01-CV-1504, Mar. 31, 2004 (3 pages).
Hon. Alexander Williams Jr. Order adopting the Special Master's Report and Recommendations in toto, and denying RJR's motion for summary judgment for indefiniteness, lack of enablement and best mode under 35 U.S. C. § 112, *Star Scientific* v. *R.J. Reynolds Tobacco Co.*, Case No. AW 01-CV-1504, Mar. 30, 2004 (2 pages).
Phillip Hampton, II, Special Master, Report and Recommendations, recommending the Court construe the claims and deny Star's motion for summary judgment for violations of 35 U.S.C. § 112, ¶2, *Star Scientific* v. *R.J. Reynolds Tobacco Co.*, Case No. AW 01-CV-1504, Dec. 4, 2003 (22 pages).
Star Scientific, Inc.'s Memorandum in Support of its Motion for Summary Judgment on Claim Construction and Definiteness (Public Version), *Star Scientific* v. *R.J. Reynolds Tobacco Co.*, Case No. AW 01-CV-1504, Apr. 28, 2003 (57 pages).
Hon. Alexander Williams, Jr. Order adopting the Special Master's Report and Recommendations in toto, and denying RJR's motion for summary judgment for invalidity based on the prior art, *Star Scientific* v. *R.J. Reynolds Tobacco Co.*, Case No. AW 01-CV-1504, Mar. 30, 2004 (2 pages).
Philip Hampton, II, Special Master, Report and Recommendations, recommending the Court deny RJR's motion for summary judgment for invalidity based on the prior art, *Star Scientific* v. *R.J. Reynolds Tobacco Co.*, Case No. AW 01-CV-1504, Feb. 23, 2004 (16 pages).
R.J. Reynolds et al.'s Memorandum in Support of its Motion for Summary Judgment No. 4: Invalidity Based on the Prior Art (Public Version), *Star Scientific* v. *R.J. Reynolds Tobacco Co.*, Case No. AW 01-CV-1504, Apr. 28, 2003 (29 pages).
Hon. Marvin J. Garbis Memorandum and Order re: Filing Date Summary Judgment Motion, denying in part and granting in part RJR's motion for summary judgment for invalidity based on the effective filing date, granting RJR's motion for partial sumary judgment establishing Sep. 15, 1999 as the effective filing date for the patents-in-suit and denying RJR's motion for summary judgment with regard to invalidity, *Star Scientific* v. *R.J. Reynolds Tobacco Co.*, Civil Action No. MJG 01-1504 (consolidated with MJG 02-2504), Jan. 19, 2007 (16 pages).
Hon. Marvin J. Garbis Corrected Memorandum and Order re: Indefiniteness, granting RJR's motion for summary judgment for invalidity based on indefiniteness, *Star Scientific* v. *R.J. Reynolds Tobacco Co.*, Civil Action No. MJG 01-1504 (consolidated with MJG 02-2504), Jun. 22, 2007 (15 pages).
Hon. Marvin J. Garbis Memorandum of Decision re: Inequitable Conduct, holding the patents-in-suit unenforceable for inequitable conduct, *Star Scientific* v. *R.J. Reynolds Tobacco Co.*, Civil Action No. MJG 01-1504 (consolidated with MJG 02-2504), Jun. 26, 2007 (47 pages).
*Star Scientific* v. *R.J. Reynolds Tobacco Co.*, 537 F.3d 1357 (Fed. Cir. 2008) (reversing invalidity for indefiniteness and unenforceability for inequitable conduct).

R.J. Reynolds et al.'s Memorandum in Opposition to Star Scientific Inc.'s Motion for Summary Judgment on Claim Construction and Defeniteness (Public Version), *Star Scientific* v. *R.J. Reynolds Tobacco Co.*, Case No. AW 01-CV-1504, May 28, 2003 (55 pages).
Star Scientific Inc.'s Objection to Magistrate Judge's Opinion and Related Orders on Defendant's "Crime-Fraud" Motion to Compel (Public Version), *Star Scientific* v. *R.J. Reynolds Tobacco Co.*, Case No. AW 01-CV-1504, May 20, 2003 (51 pages).
R.J. Reynolds et al.'s Exhibit B to its Response to the First Case Management Order, *Star Scientific* v. *R.J. Reynolds Tobacco Co.*, Civ. Action No. MJG 01-1504 (consolidated with MJG 02-2504), Dec. 23, 2008 (28 pages).
R.J. Reynolds et al.'s Response to the First Case Management Order, *Star Scientific* v. *R.J. Reynolds Tobacco Co.*, Civ. Action No. MJG 01-1504 (consolidated with MJG 02-2504), Dec. 23, 2008 (16 pages).
R.J. Reynolds et al.'s Exhibit A to its Response to the First Case Management Order, *Star Scientific* v. *R.J. Reynolds Tobacco Co.*, Civ. Action No. MJG 01-1504 (consolidated with MJG 02-2504), Dec. 23, 2008 (20 pages).
Phillip Hampton, II, Special Master, Report and Recommendations, Recommending the Court to deny RJR's motion for summary judgment for indefiniteness, lack of enablement and best mode under 35 U.S.C. § 112, *Star Scientific* v. *R.J. Reynolds Tobacco Co.*, Case No. AW 01-CV-1504, Jan. 27, 2004 (19 pages).
Frankenburg, W.G., Chemical Changes in the Harvested Tobacco Leaf, Advances in Enzymology, vol. X, pp. 326-425 (1950).
Garvin, R.T., How Prolonged Yellowing Affects the Dry-Mass Yield and Chemical Constituents of Flue-Cured Tobacco, Tobacco Science, vol. 32, pp. 13-15. (May 2, 1986).
Gondwe, W. et al., Screening Tobacco Types, Cultivars and Curing Methods for Low Nitrosamine Tobacco Production in Malawi, Agricultural Research and Extension Trust, 1996 Coresta Congress, Yokohama, Japan, Nov. 3-8, 1996, pp. 1-7. (Nov. 1996).
Hamilton, J.L. et al., Nitrate Concentration Changes During Senescence and Air Curing of Burley Tobacco, Tobacco International, vol. 184, No. 24, pp. 44-48. (Jun. 24, 1981).
Hecht, S. et al., Tobacco-Specific Nitrosamines: Formation From Nicotine in Vitro and During Tobacco Curing and Carcinogenicity in Strain A Mice, J. Natl. Cancer Inst., vol. 60, No. 4, 819-824. (Apr. 1978).
Hecht, S. et al., Chemical Studies on Tobacco Smoke. XXXIII. N-Nitrosononicotine Tobacco: Analysis of Possible Contributing Factors and Biologic Implications, J. Natl. Cancer Inst., vol. 54, No. 5, 1237-1244. (May 1974).
Hecht, S.S., Biochemistry, Biology, and Carcinogenicity of Tobacco-Specific N-Nitrosamines, Chem. Res. Toxicology, vol. 11, No. 6, pp. 559-603. (Jun. 1, 1998).
Henson et al., Yellowing Flue-Cured Tobacco in the Bulk, Tobacco Science, vol. 2, No. 11, pp. 23-28 (Mar. 14, 1958).
Hoffman, D. et al., Carcinogenic Tobacco-specific N-Nitrosamines in Snuff and in the Saliva of Snuff Dippers, Cancer Research, 43, 4305-4308 (Nov. 1981).
Hoffman, D. et al., The Role of Volatile and Nonvolatile N-Nitrosamines in Tobacco Carcinogenesis, Naylor Dana Inst. For Disease Prevention, American Health Foundation, Valhalla, New York, pp. 113-127. (1980).
Hoffman, Dietrich, Abraham Rivenson, Fung-Lung Chung, and Stephen S. Hecht, Nicotine Derived N-Nitrosamines (TSNA) and Their Relevance in Tobacco Carcinogenesis, Critical Reviews in Toxicology, vol. 21, No. 4, 1991, pp. 305-311 and handwritten notes. (1991).
Hoffman, D. et al., Nicotine derived N-Nitrosamines and Tobacco related Cancer: Current Status and Future Directions, Cancer Research, vol. 45, 935-944. (Mar. 1985).
International Search Report for International Application Serial No. PCT/US99/20909 (Dec. 23, 1999).
Johnson, CJohnson, Curing, Rec. Adv. Tob. Sci. Inaugural vol. pp. 63-68 (1974)uring, Rec. Adv. Tob. Sci. Inaugural vol. pp. 63-68 (1974).
Johnson, W.H. Bulk Curing of Bright Leaf Tobacco, Tobacco Science, vol. 4, pp. 49-55. (1966).
Johnson, W.H., Oxygen Depletion by Respiration for Bright Leaf Tobacco in a Closed Curing System, Tobacco Science, pp. 5-11. (1965).
Johnson, W.H., Influence of Harvesting and Process Variables on Bulk Curing of Bright Leaf Tobacco, Transactions of the American Society of Agricultural Engineers, vol. 8, No. 3, pp. 354-357. (1965).
Johnson, W.H., Rapid Drying of Yellowed Flue-Cured Tobacco, Tobacco Science, 40(2):58-68. (Jun. 1996).
Larsson, B.K. et al., Polycyclic Aromatic Hydrocarbons and Volatile N-Nitrosamines in Some Dried Agricultural Products, Swedish Journal of Agricultural Res., vol. 20, No. 2, pp. 49-56. (1990).
Legg, P.D. et al., Nitrogenous Constituents in Dark Air-Cured and Fire-Cured Cultivars, TCRC, No. 4009, Phillip Morris Conference InfoBase. (1986).
MacKown, C.T. et al., Tobacco-Specific N-Nitrosamines: Effect of Burley Alkaloid Isolines and Nitrogen Fertility Management, J. Agric. Food Chem. 32, No. 6, pp. 1269-1272. (1984).
MacKown, C.T. et al., Tobacco-Specific N-Nitrosamines: Formation During Processing of Midrib and Lamina Fines, J. Agric. Food Chem. vol. 36, pp. 1031-1035. (1998).
Makleit, S., Nitrosamines in Tobacco and in Cigarette Smoke, vol. 2, pp. 44-47 (Translated Publication). (1986).
Matkin, D.A. et al., Nitrosamine Reduction by Tobacco Irradiation, (U.K. & Export) Ltd., Research & Development Centre, pp. 1-21. (Mar. 1, 1989).
Matkin, D.A. et al., The Effects of Agricultural and Curing Practices on Nitrosamine Levels in Tobacco, (U.K. & Export) Ltd., Research & Development Centre. (Jun. 11, 1986).
Maw, B.W. et al., Tobacco Quality as Affected by Fan Cycling During Different Stages of Tobacco Curing, Tobacco Science, vol. 30, pp. 116-118, 1986.
Mende, P. et al., Occurrence of the Nitrosamide Precursor Pyrrolidin-(2)-One in Food and Tobacco, Carcinogenesis vol. 15, No. 4, pp. 733-737. (1994).
Mingwu, C. et al., Effect of Maleic Hydrazide Application on Accumulation of Tobacco-Specific Nitrosamines in Air-Cured Burley Tobacco, J. Agric. Food Chem, vol. 42, No. 12, pp. 2912-2916 (1994).
Mingwu, C., The Source and the Regulation of Nitrogen Oxide Production for Tobacco-Specific Nitrosamine Formation, 178 pages, Avail., UMI, Order No. DA9907718 from: Diss. Abstr. Int., B, 59(9), 4548 Dissertation. (Jun. 14, 1998).
Moreno-Vivian et al., Procaryotic Nitrate Reduction: Molecular Properties and Functional Distinction Among Bacterial Nitrate Reductases, vol. 181, No. 21, pp. 6573-6584. (Nov. 1999).
Morin, A. et al., Evolution of Tobacco Specific Nitrosamines and Microbial Populations During Flue-Curing of Tobacco Under Direct and Indirect Heating, Contributions to Tobacco Research, vol. 21, No. 1, pp. 40-46. (Mar. 2004).
Morin, A. et al., Relationship Between Tobacco-Specific Nitrosamines (TSNA) and Microbial Populations from Ontario-Grown Tobacco Flue-Cured Under Direct and Indirect Heating, Imperial Tobacco Canada Limited Canada Limited. (May 4, 2000).
Nestor, T.B. et al., Role of Oxides of Nitrogen in Tobacco-Specific Nitrosamine Formation in Flue-Cured Tobacco, Beitrage zur Tabkforschung International, vol. 20, No. 7, pp. 467-475 (Nov. 2003).
Oshima, H. et al., Identification and Occurrence of Two New N-Nitrosamino Acids in Tobacco Products: 3-(N-Nitroso N-Mehtylamino) Propionic Acid and 4-(N-Nitroso-N-Methylamino) Butyric Acid, Cancer Letters, vol. 26, pp. 153-162. (1985).
Peedin, G.F., Chapter 5: Production Practices, Tobacco: Production, Chemistry, and Technology, ed. D. Layten Davis and Mark T. Nielsen, Blackwell Sciences, Ltd. (1999).
Peele, D.M. et al., Formation of Tobacco Specific Nitrosamines in Flue-Cured Tobacco. (undated).
Qungang, Q., Information Bulletin, Cooperation Centre for Scientific Research Relative to Tobacco (CORESTA), Abstr.-Ref. 6210-6646, pp. 7-22, 1991-1992 (Sep. 1999).
Ralt, D. et al., The Role of Bacteria in Nitrosamine Formation, American Chemical Society, pp. 157-164. (Aug. 10, 1981).

Risner, C.H. and F.N. Wendelboe, Quantification of Tobacco-Specific Nitrosamines in Tobacco, Tobacco Science, vol. 38, pp. 1-6. (Jan. 1994).
Ryan et al., A Tobacco Curing Energy Model, Conference on Agricultural Engineering 1988, Hewksbury Agricultural College, NSW Sep. 25-29, 1988.
Schlotzhauer, W.S. et al., Changes in the Chemical Composition of NC 2326 Tobacco Through Ozone Treatment of Intact Leaves, Tobacco Science, vol. 31, pp. 57-60. (Oct. 1987).
Sisson, V., The Nicotiana Catalogue, Compilation of International Tobacco Germplasm Holdings, Cooperation Centre for Scientific Research Relative to Tobacco (CORESTA). (Jun. 20, 1998).
Spiegelhalder, B. et al., Formation of Tobacco-Specific Nitrosamines, B., Critical Reviews in Toxicology 21, No. 4, p. 241. (1991).
Spiegelhalder, B. et al., Tobacco-specific nitrosamines, European Journal of Cancer Prevention, vol. 5 (Supplement I), pp. 33-38. (1996).
Spiegelhalder, B., A Method for the Determination of Tobacco-specific Nitrosamines (TSNA), Nitrate and Nitrite in Tobacco Leaves and Processed Tobacco, Beitrage zur Tabakforschung International, vol. 14, No. 3, pp. 135-144. (Jan. 1989).
Stehlik, G. et al., Concentration of Dimethylnitrosamine in the Air of Smoke Filled Rooms, Ecotoxicology and Environmental Safety, No. 6, pp. 495-500. (1982).
Suggs, C.W., Dry Matter and Moisture Loss of Bright Leaf Tobacco During Curing, Tobacco Science 9, pp. 28-33. (Feb. 15, 1989).
Suggs, C.W. et al., Bulk Density and Drying Effect on Air Flow Through Flue-Cured Tobacco Leaves, vol. 33, pp. 86-90. (Feb. 24, 1989).
Suggs, C.W., Mechanical Harvesting of Flue-Cured Tobacco: Part 10: Optimization of Curing Capacity and Bulk Barn Parameters, Tobacco Science, vol. 23, pp. 126-130. (May 2, 1979).
Suggs, C.W., Mechanical Harvesting of Flue-Cured Tobacco: Part 9: Developments in Container (Box) Bulk Curing, Tobacco Science, vol. 23, pp. 1-6. (Jul. 18, 1979).
Star Scientific Report on 2009 Curing Results, dated Jul. 2010 (14 pages).

* cited by examiner

TOBACCO CURING METHOD

BACKGROUND

Fresh-cut, green tobacco has virtually no nitrosamine carcinogens. See Wiemik et al., "Effect of Air-Curing on the Chemical Composition of Tobacco," Recent Advances in Tobacco Science, Vol. 21, pp. 39 et seq., Symposium Proceedings 49th Meeting Tobacco Chemists' Research Conference, Sep. 24-27, 1995, Lexington, Ky. On the other hand, cured tobacco is known to contain a number of nitrosamines, including the harmful carcinogens N'-nitrosonomicotine (NNN) and 4-(N-nitrosomethylamino)-1-(3-pyridyl)-1-butanone (NNK). However, fresh-cut green tobacco is generally considered unsuitable for smoking or other consumption.

Tobacco-specific nitrosamines (TSNAs) are formed primarily during the curing process. It is believed the amount of tobacco-specific nitrosamine (TSNA) in cured tobacco leaf is dependent on the accumulation of nitrites, which accumulate during the death of the plant cell and are formed during curing by the reduction of nitrates under conditions approaching an anaerobic (oxygen deficient) environment. The reduction of nitrates to nitrites occurs by the action of micro flora on the surface of the leaf under anaerobic conditions, and this reduction is particularly pronounced under certain conditions (e.g., humid conditions). During the curing process, the tobacco leaf emits carbon dioxide, which can further dilute oxygen levels in the environment. Once nitrites are formed, these compounds are believed to combine with various tobacco alkaloids, including pyridine-containing compounds, to form nitrosamines.

Williams U.S. Pat. No. 6,202,649, to the present inventor, describes a method of substantially preventing formation of TSNA by, among other things, curing tobacco in a controlled environment having a sufficient airflow to substantially prevent an anaerobic condition around the vicinity of the tobacco leaf. The controlled environment is provided by controlling one or more curing parameters, such as airflow, humidity, and temperature. In practice, Virginia flue tobacco curing according to the method described in Williams '649 typically has a content of N'-nitrosonornicotine (NNN) up to about 0.05 μg/g, a content of 4-(N-nitrosomethylamino)-1-(3-pyridyl)-1-butanone (NNK) up to about 0.05 μg/g, and contents of N'-nitrosoanatabine (NAT) plus N'-nitrosoanabasine (NAB) up to about 0.1 μg/g. Although these TSNA levels are dramatically lower than levels obtained using other curing methods, in some cases it may be desirable to obtain even lower TSNA levels, such as for tobacco used in smokeless products or pharmaceuticals that are orally ingested.

SUMMARY

In one aspect, a method of substantially preventing the formation of nitrosamines in harvested tobacco comprises drying a tobacco leaf in a controlled environment having a sufficient airflow to substantially prevent an anaerobic condition around the vicinity of the leaf. The controlled environment may be provided by controlling one or more curing parameters, such as airflow, humidity, and temperature. At the time the tobacco leaf is first subjected to the controlled environment, it is in a freshly harvested, green state or at least a majority of the leaf is in a green state. By subjecting tobacco to the controlled environment while in such a state, it is possible to virtually eliminate formation of TSNA during the curing process.

In another aspect, a tobacco product such as cigarettes, cigars, chewing tobacco, snuff, tobacco-containing gum and lozenges, or powdered tobacco-based smokeless tobacco products, is prepared by forming the product from cured tobacco leaf that has been dried in a controlled environment beginning while at least a majority of the tobacco leaf is in an uncured, green state. The cured tobacco or its extract may be used to prepare pharmaceutical products for smoking cessation and/or other therapeutic treatments.

DETAILED DESCRIPTION

In accordance with the teachings of Williams U.S. Pat. No. 6,202,649, the disclosure of which is hereby incorporated by reference in its entirety, an appropriate combination of parameters such as humidity, rate of temperature change, temperature, time of treatment of the tobacco, airflow, CO level, $CO_2$ level, $O_2$ level, and arrangement of the tobacco leaves can be selected to substantially prevent the formation of TSNA during tobacco curing. For a given set of ambient conditions, it may be necessary to adjust, within the curing apparatus or barn, one or more of these parameters. For example, it may be possible to prevent the formation of TSNAs by simply providing a relatively high airflow through the curing barn. In other situations, a lower airflow can be used, provided that other parameters such as humidity, temperature, etc. are appropriately selected.

The practice of tobacco curing is more of an art than a science, as conditions during any given cure must be adjusted to take into account such factors as varietal differences, differences in leaves harvested from various stalk positions, differences among curing barns in terms of where they are used, and environmental variations during a single season or over multiple seasons, especially in terms of weather fluctuations during air-curing. The practice of flue curing is empirical to a certain degree, and is optimally carried out by individuals who have accumulated experience in this art over a significant period of time. See, e.g., Peele et al., "Chemical and Biochemical Changes During The Flue Curing Of Tobacco," Recent Advances In Tobacco Science, Vol. 21, pp. 81 et seq., Symposium Proceedings 49th Meeting Chemists' Research Conference, Sep. 24-27, 1995, Lexington, Ky. Thus, one of ordinary skill in the art of tobacco curing would understand that the outer parameters described herein, in their broadest forms, are variable to a certain extent depending on the precise confluence of the above factors for any given harvest.

The customary process used for curing green tobacco depends on the type of tobacco harvested. For example, Virginia flue (bright) tobacco is typically flue-cured, whereas Burley and certain dark strains are usually air-cured. The flue-curing of tobacco typically takes place over a period of five to seven days compared to about one to two or more months for air-curing. Flue-curing is generally divided into three stages: yellowing (35-40° C.) for about 36-72 hours (although others report that yellowing begins sooner than 36 hours, e.g., at about 24 hours for certain Virginia flue strains), leaf drying (40-57° C.) for 48 hours, and midrib (stem) drying (57-75° C.) for 48 hours. Many major chemical and biochemical changes begin during the yellowing stage and continue through the early phases of leaf drying.

In a typical flue-curing method, the yellowing stage is carried out in a barn. During this phase the green leaves gradually lose color due to chlorophyll degradation, with the corresponding appearance of the yellow carotenoid pigments. The yellowing stage typically is accomplished by closing external air vents in the barn, and holding the temperature at approximately 100-110° F. for about 3 to 5 days. The yellowed tobacco has a reduced moisture content, e.g., from about 90 wt % when green, versus about 40-70 wt % when yellow. After the yellowing stage, the air vents are opened, and the heat is gradually and incrementally raised to cure the tobacco over a period of about 5 to 7 days. At the conclusion of this period, moisture content in the tobacco usually is about 4-5 wt %. Often the cured tobacco is then subjected to reordering, which increases moisture content to about 11-15 wt %.

The exact mechanism by which tobacco-specific nitrosamines are formed is uncertain, but is believed to be enhanced by microbial activity, involving microbial nitrate reductases in the generation of nitrite during the curing process. TSNAs are believed to be formed upon reaction of amines with nitrite-derived nitrosating species, such as $NO_2$, $N_2O_3$ and $N_2O_4$ under acidic or anaerobic conditions. Tobacco leaves contain an abundance of amines in the form of amino acids, proteins, and alkaloids. The tertiary amine nicotine is the major alkaloid in tobacco, while other nicotine-type alkaloids are the secondary amines nornicotine, anatabine, and anabasine. Tobacco typically contains up to 5% of nitrate and traces of nitrite. TSNA formation is affected by such factors as plant genotype, plant maturity at harvest, curing conditions, and microbial activity.

Nitrosation of nornicotine, anatabine, and anabasine gives the corresponding nitrosamines: N'-nitrosonomicotine (NNN), N'-nitrosoanatabine (NAT), and N'-nitrosoanabasine (NAB). Nitrosation of nicotine in aqueous solution affords a mixture of 4-(N-nitrosomethylamino)-1-(3-pyridyl)-1-butanone (NNK), NNN, and 4-(N-nitrosomethylamino)-4-(3-pyridyl)-1-butanal (NNA). Less commonly encountered TSNAs include NNAL (4-N-nitrosomethylamino)-1-(3-pyridyl)-1-butanol), iso-NNAL (4-N-nitrosomethylamino)-4-(3-pyridyl)-1-butanol) and iso-NNAC (4-(N-nitrosomethylamino)-4-(3-pyridyl)-butanoic acid).

Studies have shown that nitrite and TSNA accumulate during air-curing at the time intervals starting after the end of yellowing and ending when the leaf turns completely brown, e.g., 2-3 weeks after harvest for certain air-cured strains, and approximately a week or so after harvest in flue-cured varieties. This is the time during which loss of cellular integrity occurs, due to moisture loss and leakage of the content of cells into the intercellular spaces. Therefore, there is a short window in time during air-curing when the cells have disintegrated, making the nutrition available for microorganisms. Wiernik et al have suggested that nitrite may then substantially accumulate as a result of dissimilatory nitrate reduction, thus rendering formation of TSNA possible.

There are a few published reports on the effects of microbial flora on the tobacco leaf during growth and curing and on cured tobacco, as cited in Wiernik et al. However, the involvement of microbial nitrite reductases in the generation of nitrate during curing is presumed. When cell structure is broken down after the yellow phase, and nutrients are made accessible to invading microorganisms, these may produce nitrite under favorable conditions, i.e., high humidity, optimal temperature, and anoxia.

As described in Williams '649, a window exists during the tobacco curing cycle in which the tobacco can be treated in a manner that will substantially prevent the formation of TSNA. The precise window during which TSNA formation can be substantially prevented depends on the type of tobacco and a number of other variables, including those mentioned above. Williams '649 describes the window as corresponding to a timeframe post-harvest when the leaf is yellow or undergoing the yellowing process, before the leaf turns brown, and prior to the substantial loss of cellular integrity. During this time frame, the leaves are susceptible to having the formation of TSNAs substantially prevented by subjecting the tobacco to a controlled environment as previously described. This treatment provides a dried, golden yellow leaf suitable for human consumption and, in practice, typically yields an NNN content up to about 0.05 μg/g, an NNK content up to about 0.05 μg/g, and an NAT+NAB content up to about 0.1 μg/g.

It has now been discovered that cured tobacco having levels of TSNAs even lower than those obtained by the method described in Williams '649 may be obtained by subjecting tobacco to a controlled environment while the tobacco is in a freshly-harvested, uncured, green state or shortly after onset of yellowing, e.g., such that at least a majority of the leaf is in the green state. While not wanting to be bound by theory, it is believed that the chlorophyll present in the leaf may block reduction of nitrate to nitrite, which in turn prevents nitrosation of alkaloids into TSNAs as previously described.

In one aspect, prior to subjecting uncured tobacco to a controlled environment as described herein, the yellowing stage is significantly shortened or omitted altogether. Thus, compared to the method described in Williams '649, the tobacco is less ripe at the time at which it is first subjected to the controlled environment. While the timeframe and conditions used for yellowing may vary depending on such factors as tobacco variety, climate, and the like, and further may vary from harvest to harvest and growing season to growing season for reasons previously discussed, the period for yellowing typically ranges from 0 to about 36 hours, more usually from about 18 to about 24 hours. For example, freshly harvested Virginia flue tobacco may be placed in a barn for about 18-24 hours with air recirculation at a temperature of 100-110° F.

In general, when the yellowing stage is omitted or the yellowing period is less than about 12 hours, the tobacco more or less remains in a freshly harvested, green state. As the yellowing period approaches the upper end of the aforementioned range (e.g., 24-36 hours), the relative proportion of yellow increases, e.g., the tobacco approaches a state that no longer has a majority in the green state. In general, yellowing may be carried out to an extent that surface moisture is dried, but without the significant reductions in moisture content associated with conventional yellowing. Usually, the moisture content of the tobacco after the abbreviated yellowing stage ranges from about 55 to about 85 wt %, often from about 65 to about 75 wt %.

In another aspect, in addition to shortening or omitting the yellowing stage, the tobacco may be harvested while it is in a less mature state than the state in which it is normally harvested. Less mature tobacco generally is characterized as having leafs that have smaller size and/or body than those of fully mature leafs. Also, a less mature plant typically has a greater proportion of green color throughout the plant, e.g., the plant is entirely green or only a small fraction of the plant has begun to turn yellow.

The conditions for curing tobacco in a controlled environment that may be used to substantially prevent formation of TSNA are detailed in Williams '649 and will be briefly summarized below. The controlled environment is principally defined by an airflow sufficient to substantially prevent an anaerobic condition around the vicinity of the leaf, and may be created by controlling one or more curing parameters such as airflow, temperature, and humidity. A commercially available dehumidifier or humidifier may be used to control humidity levels. For example, heated or unheated air may be dehumidified air to a relative humidity level of less than about 85%, less than about 60%, or less than about 50% in the curing barn.

The air may be fresh outside air, and should be free or substantially free of combustion exhaust gases. As discussed in Williams '649, combustion exhaust gases, including water vapor, carbon monoxide, and carbon dioxide, dilute ambient oxygen levels, creating anaerobic conditions that lead to TSNA formation through microbial activity. The air may be recirculated as long as an anaerobic condition is substantially prevented.

The temperature within the curing barn typically ranges from ambient (e.g., unheated air) to about 250° F. or more. Excessive temperatures may lead to charring the tobacco and should be avoided. For example, the curing temperature may range from about 100° F. to about 250° F., often from about 160° F. to about 170° F. The optimum temperature within the curing barn can be determined for each case, depending on environmental conditions, tobacco variety, and the like.

The determination of the time for treating the tobacco in the controlled environment may be determined by trial and error. Most often, the treatment time ranges from about 2-4 days. Due to shortening or omitting the yellowing stage, the overall time for processing the tobacco from harvest may be reduced, for example by about 18 to 48 hours, compared to the method described in Williams '649.

The arrangement of the tobacco leaves in the barn is not critical, but it may be advantageous to maximize the exposed surface area of the tobacco leaves. Air circulation within the barn may be of a vertical or horizontal draft design, with the flow of air being in any suitable direction, with manually or automatically controlled fresh air dampers and weighted exhaust dampers. The barn may include a heat exchanger system supplied with a flame detector, igniter wire, sensor cable, dual valve gas train and/or air proving switch.

The resulting cured tobacco typically has individual contents of the nitrosamines NNN, NNK, NAT, and NAB that are below detection limits, e.g., below 0.02 μg/g, as well as a collective content of NNN, NNK, NAT, and NAB that are below detection limits.

The methods described herein may be used with all strains of tobacco, including flue (bright) varieties, Burley varieties, dark varieties, oriental/Turkish varieties, etc. The cured tobacco may be used in any type of tobacco products, non-limiting examples of which include cigarettes, cigars, chewing tobacco, snuff, and tobacco-containing gum, lozenges, and dissolvable strips. The cured tobacco is particularly suitable for use in smokeless products prepared from powdered tobacco, as described in Williams U.S. Pat. Nos. 6,834,654 and 6,668,839, the disclosures of which are hereby incorporated by reference in their entireties. As described in Williams '654 and '839, powdered tobacco-based smokeless products may be prepared from tobacco extracts or from pulverized tobacco. The cured tobacco, typically in extract form, also may be used to prepare pharmaceutical products for smoking cessation and/or other therapeutic treatments. As will be appreciated by persons skilled in the art, because the tobacco is cured while in a less ripe state, some consumers may consider properties such as color and taste less desirable for some types of products such as cigarettes.

EXAMPLES

The following examples are provided for illustrative purposes only and should not be construed as limiting the scope of the present invention. Examples 1-3 illustrate curing tobacco in a controlled environment beginning while a majority of the tobacco was in a green state. Comparative Examples 1 and 2 illustrate curing tobacco in a controlled environment beginning while a majority of the tobacco was in a yellow state.

Harvested green tobacco was placed in a curing barn at 105° F. with the external air vents closed at an airflow of about 25,000 CFM for yellowing (except for Example 1, where the yellowing stage was omitted). At the conclusion of the yellowing stage, the external air vents were opened and the air temperature was increased to 165° F. for a period of about 2-4 days. Table 1 below indicates the approximate time periods and condition of each tobacco sample at the end of the yellowing stage, and the levels of NNN, NAT, NAB, and NNK measured in the resulting cured tobacco.

TABLE 1

| Example | % Yellow at end of yellowing stage | Yellowing Time (hr) | NNN (μg/g) | NAT (μg/g) | NAB (μg/g) | NNK (μg/g) | TSNA (μg/g) |
|---|---|---|---|---|---|---|---|
| 1 | 0 | 0 | N.D. | N.D. | N.D. | N.D. | N.D. |
| 2 | 20 | 18-24 | N.D. | N.D. | N.D. | N.D. | N.D. |
| 3 | 35 | 24-30 | N.D. | N.D. | N.D. | N.D. | N.D. |
| Comp. 1 | 80 | 36-48 | N.D. | 0.067 | N.D. | 0.023 | 0.090 |
| Comp. 2 | 100 | 60-72 | 0.095 | 0.056 | N.D. | N.D. | 0.151 |

N.D. = below detection limit

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

I claim:

1. A method of curing harvested tobacco comprising:

drying tobacco leaf in a controlled environment and for a time sufficient to substantially prevent formation of at least one nitrosamine, wherein the controlled environment comprises an airflow sufficient to substantially prevent an anaerobic condition around the vicinity of the leaf, and wherein the controlled environment is provided by controlling at least one of humidity, temperature, and airflow;

wherein the tobacco leaf is first subjected to the controlled environment while it is uncured and at least a majority of the leaf is in a green state; and wherein a yellowing stage is omitted or yellowing is carried out for not more than 18 hours.

2. The method of claim 1, wherein the air is heated to about 100° F. to about 250° F.

3. The method of claim 2, wherein the air is heated to about 160° F. to about 170° F.

4. The method of claim 1, wherein the tobacco leaf is dried for a treatment period ranging from about 2 to about 4 days.

5. The method of claim 1, wherein the at least one nitrosamine is N'-nitrosonornicotine.

6. The method of claim 1, wherein the at least one nitrosamine is 4-(N -nitrosomethylamino)-1-(3-pyridyl)-1-butanone.

7. The method of claim 1, wherein the at least one nitrosamine is N'-nitrosoanatabine.

8. The method of claim 1, wherein the at least one nitrosamine is N'-nitrosoanabasine.

9. The method of claim 1, wherein the tobacco is a Virginia flue variety.

10. The method of claim 1, wherein the tobacco is a Burley variety.

11. The method of claim 1, wherein the yellowing stage is omitted.

12. The method of claim 1, wherein yellowing is carried out at a temperature of about 100 to 110° F.

13. The method of claim 1, wherein yellowing is carried out for about 12 hours to not more than 18 hours.

14. A method of bulk curing harvested tobacco comprising:

placing harvested tobacco leaf in a curing barn;

drying the tobacco leaf in a controlled environment and for a time sufficient to substantially prevent formation of at least one nitrosamine, wherein the controlled environment comprises an airflow sufficient to substantially prevent an anaerobic condition around the vicinity of the leaf, and wherein the controlled environment is provided by controlling at least one of humidity, temperature, and airflow;

wherein the tobacco leaf is first subjected to the controlled environment while it is uncured and at least a majority of the leaf is in a green state; and wherein a yellowing stage is omitted or yellowing is carried out for not more than 18 hours.

15. The method of claim 14, wherein the air is heated to about 100° F. to about 250° F.

16. The method of claim 15, wherein the air is heated to about 160° F. to about 170° F.

17. The method of claim 14, wherein the tobacco leaf is dried for a treatment period ranging from about 2 to about 4 days.

18. The method of claim 14, wherein the at least one nitrosamine is N'-nitrosonornicotine.

19. The method of claim 14, wherein the at least one nitrosamine is 4-(N -nitrosomethylamino)-1-(3-pyridyl)-1-butanone.

20. The method of claim 14, wherein the at least one nitrosamine is N'-nitrosoanatabine.

21. The method of claim 14, wherein the at least one nitrosamine is N'-nitrosoanabasine.

22. The method of claim 14, wherein the tobacco is a Virginia flue variety.

23. The method of claim 14, wherein the tobacco is a Burley variety.

24. The method of claim 14, wherein the yellowing stage is omitted.

25. The method of claim 14, wherein yellowing is carried out at a temperature of about 100 to 110° F.

26. The method of claim 14, wherein yellowing is carried out for about 12 hours to not more than 18 hours.

* * * * *